US006154184A

United States Patent [19]

Endo et al.

[11] Patent Number: 6,154,184

[45] Date of Patent: Nov. 28, 2000

[54] ANTENNA APPARATUS FOR PORTABLE PHONES

[75] Inventors: Tsutomu Endo; Isamu Chiba; Shuji Urasaki, all of Tokyo, Japan

[73] Assignee: Mitsubishi Denki Kabushiki Kaisha, Tokyo, Japan

[21] Appl. No.: 09/445,561

[22] PCT Filed: Jun. 30, 1998

[86] PCT No.: PCT/JP98/02937

§ 371 Date: Dec. 9, 1999

§ 102(e) Date: Dec. 9, 1999

[87] PCT Pub. No.: WO00/01029

PCT Pub. Date: Jan. 6, 2000

[51] Int. Cl.[7] ..... H01Q 1/24; H01Q 1/36

[52] U.S. Cl. ..... 343/895; 343/702; 343/727; 343/730

[58] Field of Search ..... 343/895, 853, 343/700 MS, 850, 702, 725, 726, 727, 728, 729, 730; H01Q 1/24, 1/36

[56] References Cited

U.S. PATENT DOCUMENTS

| | | | |
|---|---|---|---|
| 5,909,196 | 6/1999 | O'Neill, Jr. | 343/895 |
| 6,005,521 | 12/1999 | Suguro et al. | 343/700 MS |
| 6,072,441 | 6/2000 | Tanabe | 343/895 |

FOREIGN PATENT DOCUMENTS

| | | |
|---|---|---|
| 1311604 | 12/1989 | Japan . |
| 3236612 | 10/1991 | Japan . |
| 738326 | 2/1995 | Japan . |
| 9107237 | 4/1997 | Japan . |
| 993025 | 4/1997 | Japan . |

*Primary Examiner*—Hoanganh Le
*Attorney, Agent, or Firm*—Rothwell, Figg, Ernst & Manbeck P.C.

[57] ABSTRACT

An antenna apparatus for a portable telephone which is capable of having a better gain characteristic and also capable of achieving a better circularly polarized characteristic over a wide range is provided. This antenna apparatus is comprised of: a first cylinder 4 provided in such a manner that the first cylinder is uprighted on an upper portion 1 of a housing of the portable telephone; 4-element dipole array antennas 4*a* to 4*d* connected to a transmitter/receiver circuit built in the housing via a feeding line path, and arranged on the surface of the first cylinder in an equiinterval in such a manner that the 4-element dipole array antennas have inclined angles with respect to a central axis of the first cylinder, an element length of the 4-element dipole array antennas being equal to an approximately ½ electromagnetic wavelength; a second cylinder 5 having a diameter smaller than an inner diameter of the first cylinder, and arranged in such a manner that the second cylinder can be stored into the first cylinder, and when the second cylinder is drawn from the first cylinder, the second cylinder is uprighted in the vicinity of an upper space of the first cylinder in a coaxial manner; and 4-element line-shaped conductors 5*a* to 5*d* arranged on the surface of the second cylinder in an equiinterval in such a manner that the 4-element line-shaped conductors have inclined angles with respect to a central axis of the second cylinder.

8 Claims, 7 Drawing Sheets

ANTENNA APPARATUS FOR PORTABLE PHONES

TECHNICAL FIELD

The present invention relates to an antenna apparatus for a portable telephone which is capable of achieving a better gain characteristic and also a circularly polarized wave characteristic in a wide range and capable of realizing superior portability.

BACKGROUND ART

This sort of antenna apparatus is disclosed in the publication No. B-1-51 issued by Japanese Electronic Information Communication Institute Society in 1997.

FIG. 13 is a structure diagram showing a helical antenna equipped with a mobile communication terminal housing, indicated in the above-explained publication.

The helical antenna 11 shown in FIG. 13 can have the better gain and circularly polarized wave characteristics over the wide range as shown in FIG. 14 to FIG. 17. That is, this helical antenna 11 is uprighted over a metal housing 10 keeping a predetermined interval "d", and while 2 sets of line-shaped elements are intersected with each other, the respective line-shaped elements are bent in a helical shape. Then, the electric power is fed to the summit portions of the first line-shaped element and the second line-shaped element maintaining such a phase relationship of 90 degrees.

In other words, FIG. 14 to FIG. 17 are characteristic diagrams showing the test results performed in such that the adverse influences are given to the radiation characteristic of the metal housing 10 when the helical antenna 11 is employed as the antenna for the mobile communication terminal. As apparent from the changes in the vertical plane directivity caused by the interval "d" shown in FIG. 14 and FIG. 15, there is substantially no adverse influence given to the directivity caused by the metal housing 10 in the vertex direction. Also, as apparent from the axial ratio characteristics indicated in FIG. 16 and FIG. 17, there is a relatively small adverse influence caused by the metal housing 10. As a result, it may be seen that since there is a small adverse influence given to the various characteristics caused by the metal housing 10, the helical antenna 11 is suitable for the antenna mounted on the mobile communication terminal housing.

However, the length of the metal housing 1 shown in FIG. 13 is 150 mm, and the length of the helical antenna 2 is 80 mm. When the interval "d" between this helical antenna 2 and the metal housing 1 is involved, the total length exceeds 230 mm, which may deteriorate portability.

One solution is conceivable to avoid this deterioration of portability. That is, the antenna main body may be stored into the mobile communication terminal housing. However, if the helical antenna main body is storable into the mobile communication terminal housing, there arises a problem that it is difficult that the power feeding circuit is made movable.

In other words, FIG. 18 indicates the power feeding circuit unit described in "A New GCPW Resonant Quadrifiler Helix Antennas for GPS Land Mobile Applications" of IEEE AP-S 1997 Digest 664 in FIG. 1. The electric power supplied from the power feeding circuit unit 12 is branched from a single feeding cable provided in the cylinder via a balun shortcircuit unit 13 to 2 pairs of feeding cables so as to energize the respective radiation elements 17 of the helical antenna. In this case, 4 sets of the feeding cables provided in the cylinder and for supplying the electric power to the respective radiation elements 17 cannot be made of flexible structures, but are constructed of the fixed circuit arrangement. As a result, there is a problem that it is difficult to make the power feeding circuit movable.

The present invention has been made to solve the above-described problems, and therefore has an object to provide such an antenna apparatus for a portable telephone. That is, since the movable radiation elements are provided in the vicinity of a fixed antenna for energization purpose in such a manner that these movable radiation elements are stacked on this fixed antenna in a coaxial manner but are not electrically connected to this fixed antenna, this antenna apparatus for the portable telephone can have the better circularly polarized wave characteristic and the superior portability.

DISCLOSURE OF THE INVENTION

An antenna apparatus for a portable telephone according to the present invention comprises: a first cylinder provided in such a manner that the first cylinder is uprighted on an upper portion of a housing of the portable telephone; 4-element dipole array antennas connected to a transmitter/receiver circuit built in the housing via a feeding line path, and arranged on the surface of the first cylinder in an equiinterval in such a manner that the 4-element dipole array antennas have inclined angles with respect to a central axis of the first cylinder, an element length of the 4-element dipole array antennas being equal to an approximately ½ electromagnetic wavelength; a second cylinder having a diameter smaller than an inner diameter of the first cylinder, and arranged in such a manner that the second cylinder can be stored into the first cylinder, and when the second cylinder is drawn from the first cylinder, the second cylinder is uprighted in the vicinity of an upper space of the first cylinder in a coaxial manner; and 4-element line-shaped conductors arranged on the surface of the second cylinder in an equiinterval in such a manner that the 4-element line-shaped conductors have inclined angles with respect to a central axis of the second cylinder.

Also, the antenna apparatus for the portable telephone is characterized in that each of the 4-element line-shaped conductors has an element length equal to an approximately ½ electromagnetic wavelength.

Also, the antenna apparatus for the portable telephone is characterized in that 2 sets of elements among the 4-element line-shaped conductors located opposite to each other with respect to the central axis of the second cylinder are short-circuited at an upper end and a lower end of the second cylinder.

Also, the antenna apparatus for the portable telephone is characterized by further comprising one pair of disk-shaped conductors provided on an upper end and a lower end of the second cylinder, all of the 4-element line-shaped conductors being shortcircuited by the one pair of disk-shaped conductors on the upper end and the lower end of the second cylinder.

Also, the antenna apparatus for the portable telephone is characterized by further comprising one pair of toroidal-shaped conductors provided on an upper end and a lower end of the second cylinder, all of the 4-element line-shaped conductors being shortcircuited by the one pair of toroidal-shaped conductors on the upper end and the lower end of the second cylinder.

Also, the antenna apparatus for the portable telephone is characterized in that each of the 4-element line-shaped conductors has an element length equal to a length defined by multiplying an approximately ¼ electromagnetic wavelength by an odd number, and 2 sets of line-shaped conductors among the 4-element line-shaped conductors located opposite to each other with respect to the central axis of the second cylinder are shortcircuited with each other at upper end of the second cylinder.

Also, the antenna apparatus for the portable telephone is characterized in that each of the 4-element line-shaped conductors has an element length equal to a length defined by multiplying an approximately ¼ electromagnetic wavelength by an odd number, and by further comprising a disk-shaped conductor provided on an upper end of the second cylinder, all of the 4-element line-shaped conductors being shortcircuited by the disk-shaped conductor on the upper end of the second cylinder.

Also, the antenna apparatus for the portable telephone is characterized in that each of the 4-element line-shaped conductors has an element length equal to a length defined by multiplying an approximately ¼ electromagnetic wavelength by an odd number, and by further comprising a toroidal-shaped conductor provided on an upper end of the second cylinder, all of the 4-element line-shaped conductors being shortcircuited by the toroidal-shaped conductor on the upper end of the second cylinder.

BEST MODE FOR CARRYING OUT THE INVENTION

EMBODIMENT MODE 1

Figure 1:
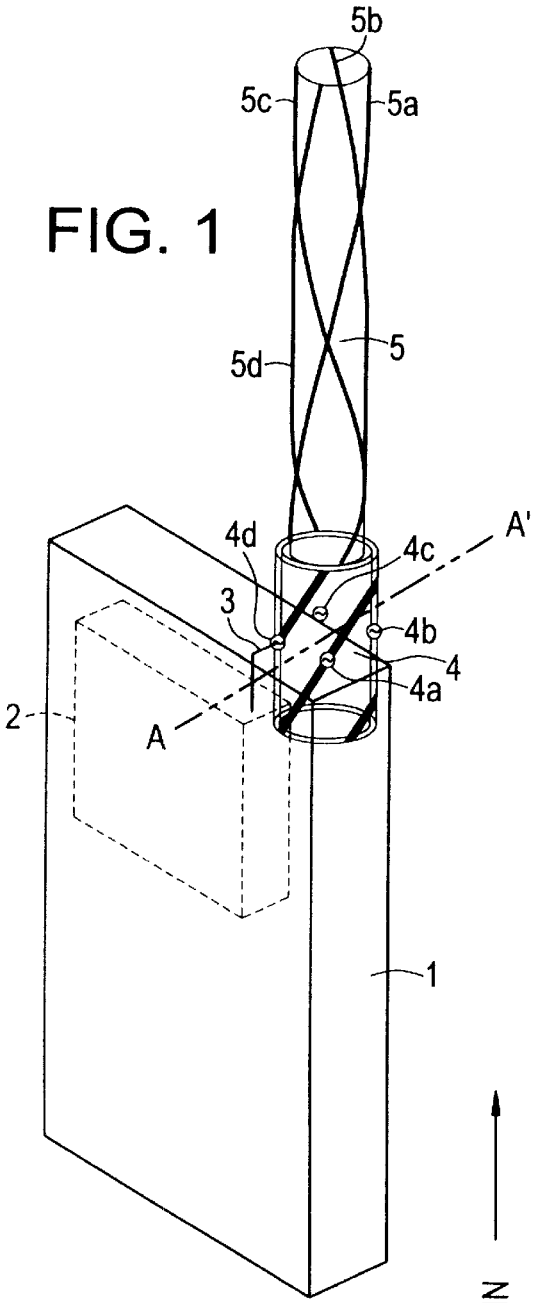
FIG. 1 is a conceptional structure diagram showing an antenna apparatus for a portable telephone according to an embodiment mode 1 of the present invention.

FIG. 1 is a conceptional structure diagram showing an embodiment mode 1 of the present invention.

In FIG. 1, reference numeral 1 indicates a housing of a portable telephone; 2 indicates a transmitter/receiver circuit build in the housing 1; and 3 indicates a feeding line path used to connect a feeding circuit (not shown) employed in the transmitter/receiver circuit 2 with a dipole array antenna that will be discussed later. Also, reference numeral 4 indicates a first cylinder fixed so as to be uprighted on an upper portion of the housing 1, and 4-element dipole array antennas 4*a* to 4*d* are provided on the surface of this first cylinder 4. The 4-element dipole array antennas 4*a* to 4*d* have such element lengths equal to an approximately ½ electromagnetic wavelength, and are arranged in an equiinterval in such a way that these dipole array antennas have inclined angles with respect to a central axis of the first cylinder 4.

Also, reference numeral 5 indicates a second cylinder having a diameter smaller than an inner diameter of the above-explained first cylinder 4. This second cylinder 5 can be stored into the first cylinder 4, and is provided in such a manner that when this second cylinder 5 is drawn from the first cylinder 4, the second cylinder 5 is uprighted in the vicinity of an upper space of the first cylinder 4 on a coaxial position. Four-element line-shaped conductors 5*a* to 5*d* are provided on the surface of this second cylinder 5 in an equiinterval in such a manner that these 4-element line-shaped conductors 5*a* to 5*d* have inclined angles with respect to the central axis of the second cylinder 5. The 4-element line-shaped conductors 5*a* to 5*d* have element lengths equal to an approximately ½ electromagnetic wavelength.

Next, a basic principle of operation will be explained.

Figure 2:
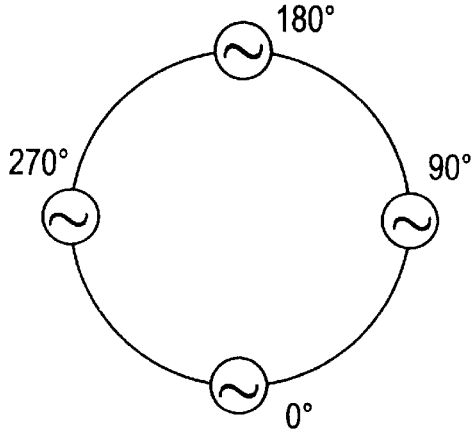
FIG. 2 is an explanatory diagram explaining a feeding phase of a dipole array antenna provided on the surface of a first cylinder according to the embodiment mode 1 of the present invention.

FIG. 2 is a diagram showing a sectional view of the 4-element dipole array antennas provided on the first cylinder 4 in a horizontal plane containing a line A–A' indicated in FIG. 1, as viewed from the upper direction.

Figure 3:
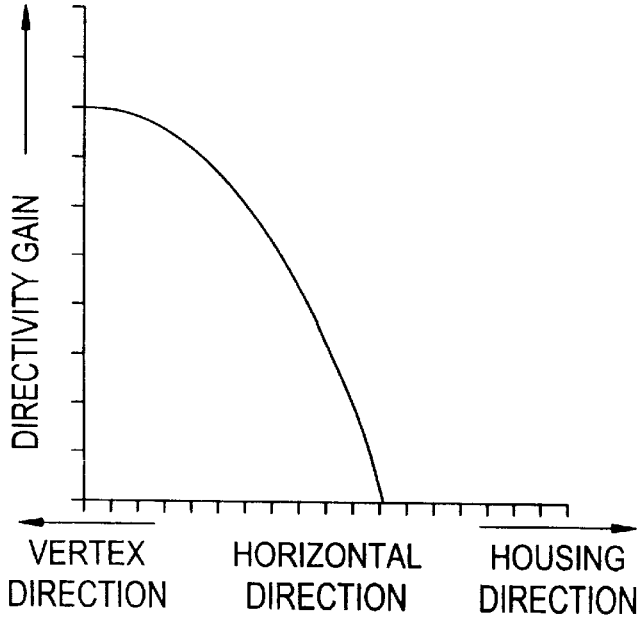
FIG. 3 is a radiation characteristic diagram showing a radiation pattern of the dipole array antenna within a vertical plane, provided on the surface of the first cylinder according to the embodiment mode 1 of the present invention.
Figure 13:
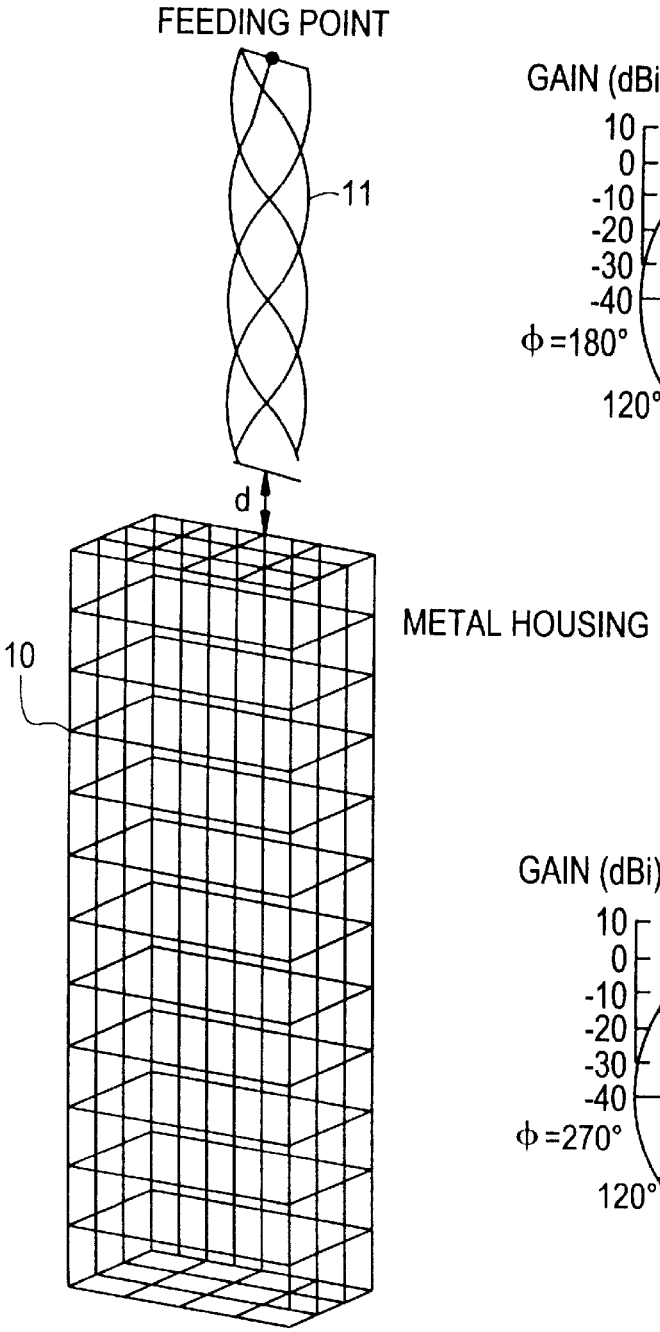
FIG. 13 is a conceptional structure diagram showing a conventional antenna apparatus for a portable telephone.
Figure 14:
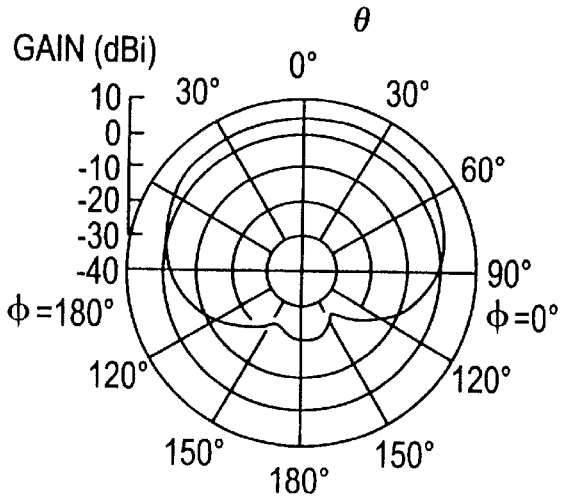
FIG. 14 is a radiation characteristic diagram showing a vertical plane directivity of the conventional antenna apparatus for the portable antenna.
Figure 15:
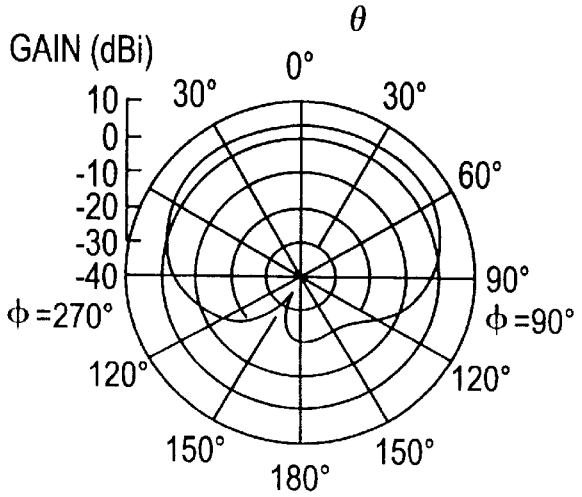
FIG. 15 is a radiation characteristic diagram showing the vertical plane directivity of the conventional antenna apparatus for the portable antenna.
Figure 16:
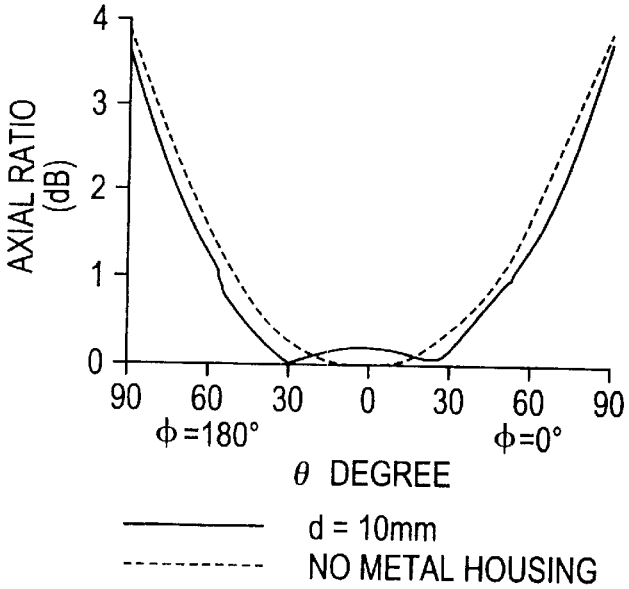
FIG. 16 is a characteristic diagram showing an axial ratio characteristic of the conventional antenna apparatus for the portable telephone.
Figure 18:
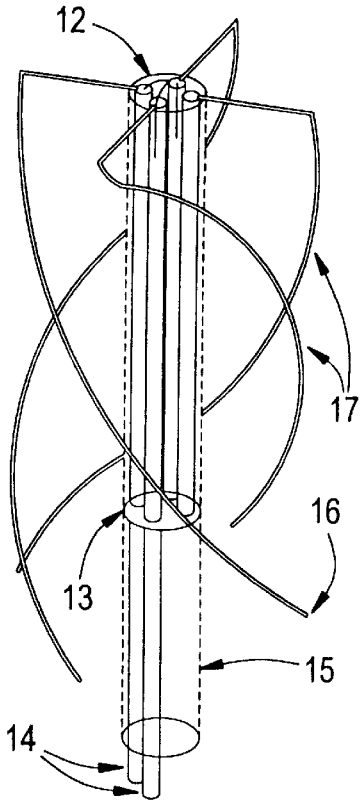
FIG. 18 is a structure diagram showing the feeding circuit unit indicated in IEEE AP-S 1997 Digest 664 "A New GCPW Resonant Quadrifiler Helix Antenna for GPS Land Mobile Applications" in FIG. 1.
Figure 17:
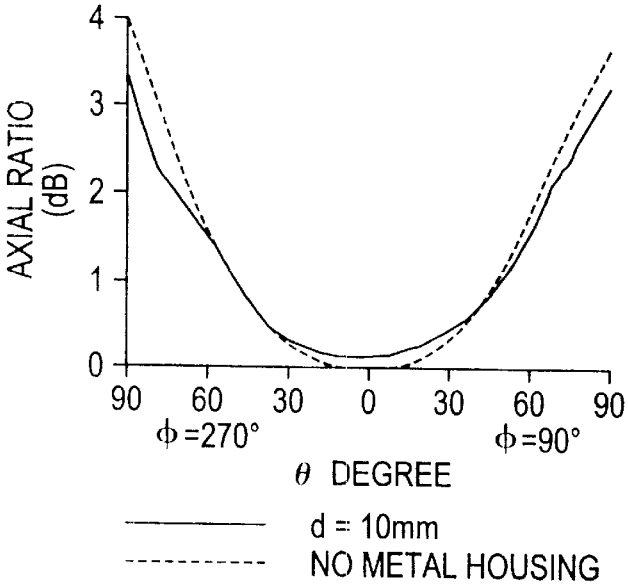
FIG. 17. is a characteristic diagram showing the axial ratio characteristic of the conventional antenna apparatus for the portable telephone.

As indicated in FIG. 2, in the case that the 4-element dipole array antennas provided on the first cylinder 4 are energized by feeding electric power via the feeding line path 3 while the phase is led along the left circular direction, a left-turn circularly polarized wave is produced from the antenna structure of FIG. 1. Then, as indicated in FIG. 3, a radiation pattern within a vertical plane becomes a shape so as to have a large gain in a vertex direction. It should be noted that as described in a publication disclosing a structure shown in FIG. 13, since there is a small adverse influence caused from the housing, a radiation pattern within a horizontal plane may constitute such a radiation pattern shape of an omnidirectional characteristic similar to a characteristic of a single antenna.

Now, in such a case that the second cylinder 5 having the 4-element line-shaped conductors 5*a* to 5*d* is located in the vicinity of the upper space of the first cylinder 4 in such a way that this second cylinder 5 is not electrically connected to the first cylinder 4, and furthermore, an interval between the first and second cylinders 4 and 5 is selected to be a proper value, the 4-element dipole array antennas 4*a* to 4*d* provided on the surface of the first cylinder 4 are capacitive-coupled with the 4-element line-shaped conductors 5*a* to 5*d* provided on the surface of the second cylinder 5, respectively. Four-element line-shaped conductors 5*a* to 5*d* are provided on this surface of the second cylinder 5 in the equiinterval in such a manner that these 4-element line-shaped conductors 5*a* to 5*d* have inclined angles with respect to the central axis of the second cylinder 5. The 4-element line-shaped conductors 5*a* to 5*d* have the element lengths equal to approximately ½ electromagnetic wavelength. Then, the 4-element line-shaped conductors 5*a* to 5*d* provided on the surface of the second cylinder 5 are energized by feeding the electric power as 4-element dipole array antennas in a similar phase relationship with the respective four elements of the dipole array antennas provided on the surface of the first cylinder 4. As a consequence, the resulting radiation pattern becomes such a radiation pattern within a vertical plane indicated by a solid line of FIG. 4, and also the 4-element dipole array antennas made of the 4-element line-shaped conductors 5*a* to 5*d* may become a circularly polarized antenna having a better gain over a wide range, as compared with the dipole array antenna provided on the surface of the first cylinder 4.

Figure 4:
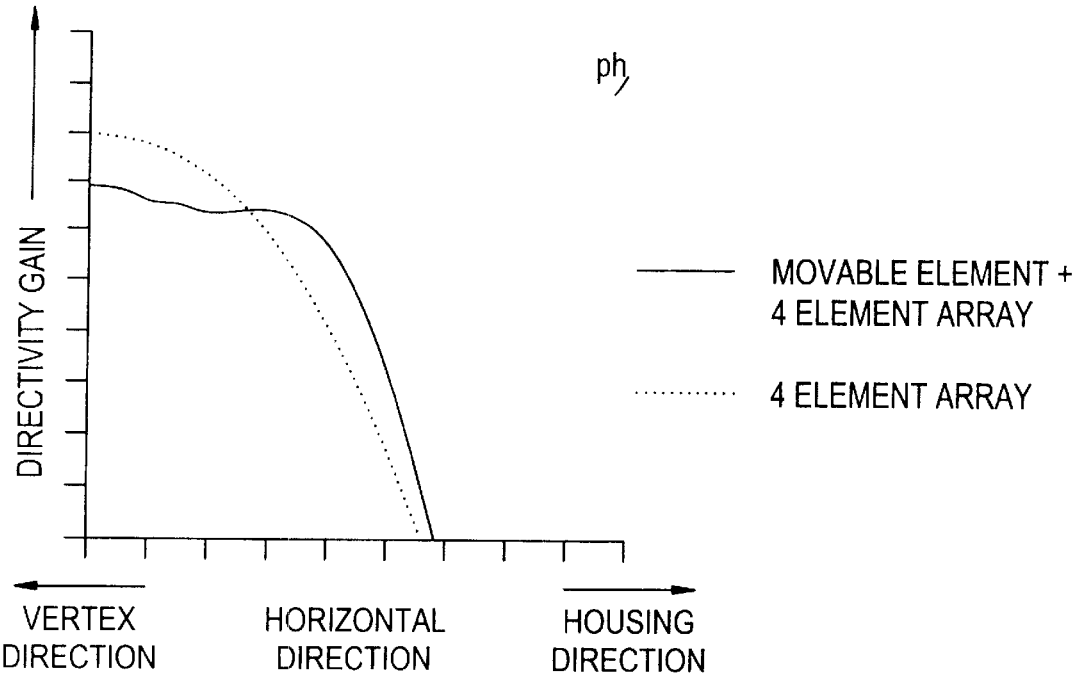
FIG. 4 is a radiation characteristic showing a comparison result between a radiation pattern of the entire antenna apparatus for the portable telephone, according to the embodiment mode 1 of the present invention, and a radiation pattern of only the dipole array antenna within the respective vertical planes.
Figure 5:
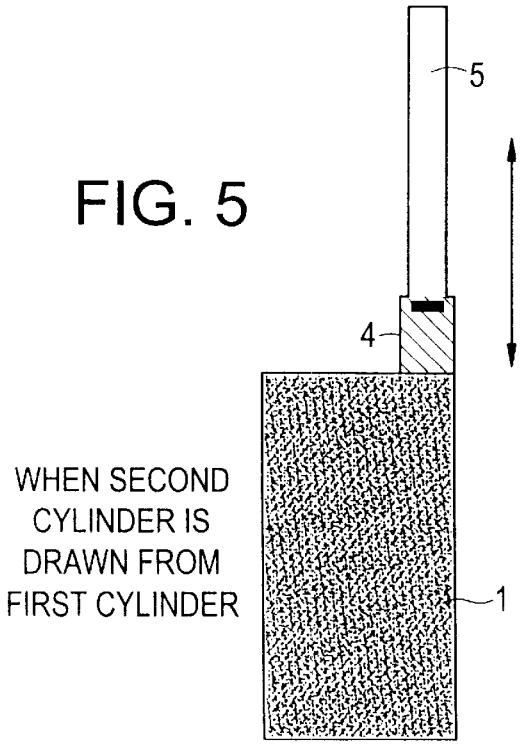
FIG. 5 is an explanatory diagram explaining such a condition that the antenna according to the embodiment mode 1 of the present invention is drawn from a housing.
Figure 6:
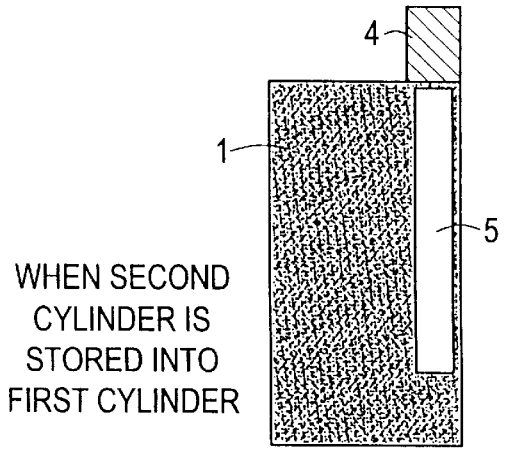
FIG. 6 is an explanatory diagram explaining such a condition that the antenna according to the embodiment mode 1 of the present invention is stored into the housing.

Furthermore, since the second cylinder 5 is not fixed, when this second cylinder 5 is drawn from the first cylinder 4 as shown in FIG. 5, the circularly polarized antenna made by the line-shaped conductors 5*a* to 5*d* has such a radiation characteristic as indicated by a solid line shown in FIG. 4. Also, when the second cylinder 5 is stored into the first cylinder 4 as indicated in FIG. 6, this circularly polarized antenna has such a radiation characteristic as shown in FIG. 3. Thus, the entire structure of the portable telephone can be made compact with superior portability.

As a consequence, in accordance with the above-described embodiment mode 1, the antenna apparatus for the portable telephone is arranged as follows. That is, the 4-element line-shaped conductors 5*a* to 5*d* provided on the second cylinder 5 extendable on the first cylinder 4 in a coaxial manner are stacked with respect to the 4-element dipole array antennas 4*a* to 4*d*, and also are not electrically connected to these 4-element dipole array antennas 4*a* to 4*d* while being positioned close to these 4-element dipole array antenna. The 4-element dipole array antennas 4*a* to 4*d* are provided as an energizing antenna provided on the surface of the first cylinder which is fixed on the upper portion of the housing 1 in such a way that these 4-element dipole array antennas 4*a* to 4*d* are uprighted on this upper portion. Thus, the antenna apparatus can have the better circularly polarized characteristic over the wide range, and also the superior portability.

EMBODIMENT MODE 2

Figure 7:
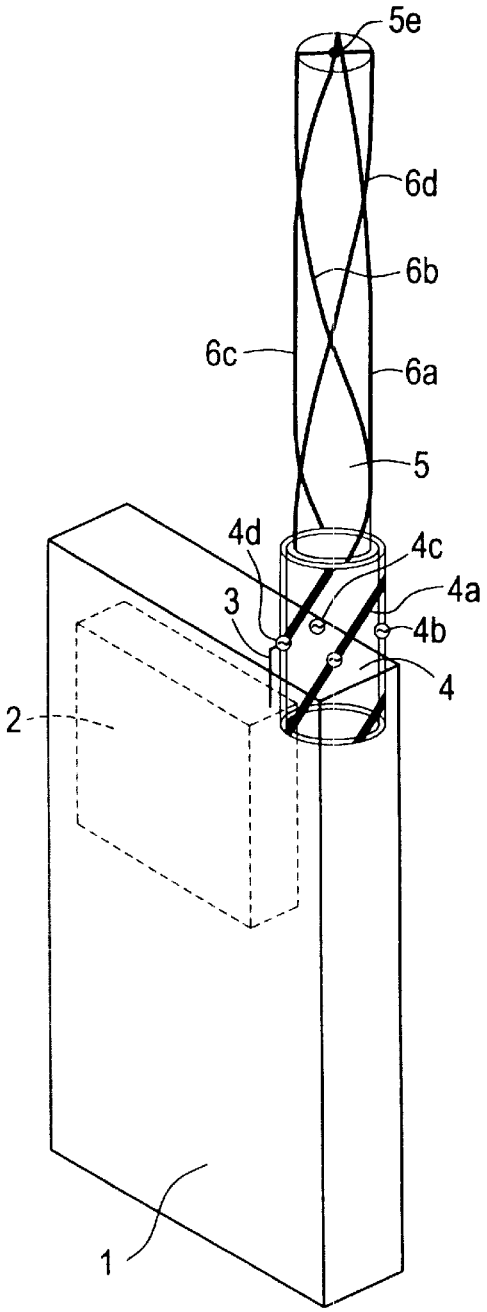
FIG. 7 is a conceptional structure diagram showing an antenna apparatus for a portable telephone according to an embodiment mode 2 of the present invention.

FIG. 7 is a conceptional structure diagram showing an embodiment mode 2 of the present invention.

It should be understood that the same reference numerals shown in the embodiment mode 1 of FIG. 1 will be employed as those for denoting the same, or similar structural elements indicated in FIG. 7, and descriptions thereof are omitted. As newly employed reference numerals, reference numerals 6*a* to 6*d* indicate 4-element line-shaped conductors having an element length equal to a length defined by multiplying an approximately ¼ electromagnetic wavelength by an odd number. The 4-element line-shaped conductors 6*a* to 6*d* are arranged on the surface of the second cylinder 5 in an equiinterval, and also have inclined angles with respect to a central axis of the second cylinder 5. These 4-element line-shaped conductors 6*a* to 6*d* are shortcircuited with such elements located opposite to each other at an upper end 5*e* of the second cylinder 5, so that pairs of line-shaped conductors are constructed. In this case, an element length of two elements is equal to a length defined by multiplying an approximately ½ electromagnetic wavelength by an integer number.

Next, a basic principle of operation will be described.

Similar to the embodiment mode 1, in such a case that the 4-element dipole array antennas 4*a* to 4*d* provided on the first cylinder 4 are energized by feeding electric power via the feeding line path 3 while the phase is led along the left circular direction, the second cylinder 5 having the 4-element line-shaped conductors 6*a* to 6*d* is located in the vicinity of the upper space of the first cylinder 4 while the second cylinder 5 is not electrically connected to the first cylinder 4, and further, an interval between the first cylinder 4 and the second cylinder 5 is selected to be a proper value, the elements 4*a* to 4*d* provided on the surface of the first cylinder 4 are capacitive-coupled to the elements 6*a* to 6*d* provided on the surface of the second cylinder 6. As previously explained, the 4 elements 6*a* to 6*d* are shortcircuited to the paired elements located opposite to each other at an upper end 6*e* of the second cylinder 5. As a result, the 4-element line-shaped conductors 6*a* to 6*d* are energized by feeding electric power as an array antenna of a line-shaped conductor pair, the 2-element length of which becomes a length defined by multiplying an approximately ½ electromagnetic wavelength by an integer number.

It should be also noted that since the above-described 2-element dipole array antenna constituted by shortcircuiting the opposite elements with each other is energized by feeding the electric power keeping a phase relationship similar to that of the respective elements of the dipole array antennas provided on the surface of the first cylinder 4, a similar antenna characteristic to that of the embodiment mode 1 can be obtained. Also, a point where the 2-element dipole array antennas are intersected on the surface of the upper end 5*e* of the second cylinder 5 is located at an axial symmetrical position. Therefore, even when the antenna elements are shortcircuited to each other, a similar performance can be obtained.

EMBODIMENT MODE 3

Figure 8:
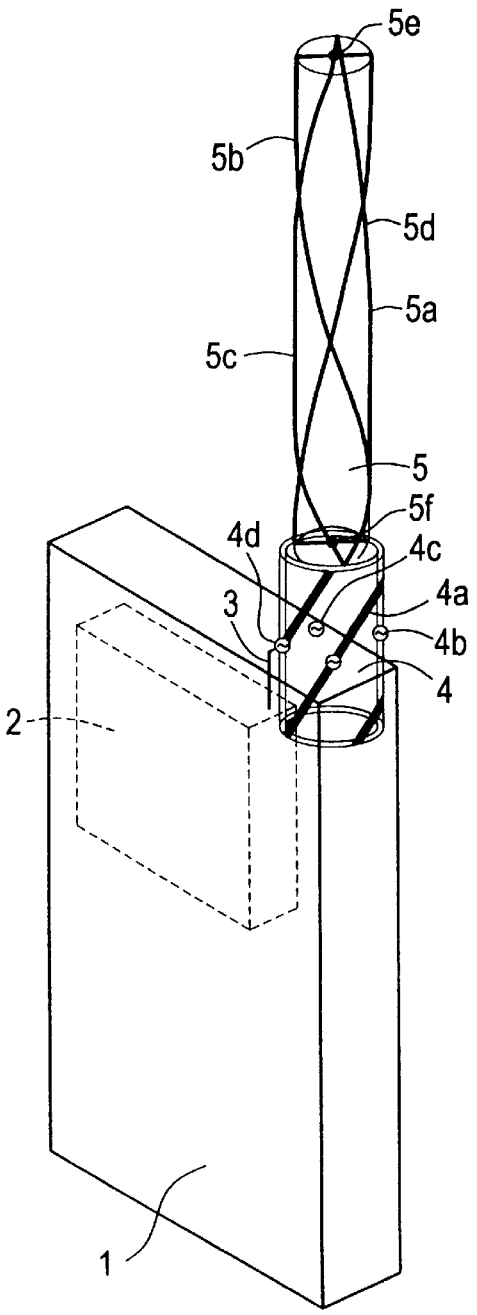
FIG. 8 is a conceptional structure diagram showing an antenna apparatus for a portable telephone according to an embodiment mode 3 of the present invention.

FIG. 8 is a conceptional structure diagram showing an embodiment mode 3 of the present invention.

It should be understood that the same reference numerals shown in the embodiment mode 1 of FIG. 1 will be employed as those for denoting the same, or similar structural elements indicated in FIG. 8, and descriptions thereof are omitted. As newly employed reference numerals, reference numerals 5*e* and 5*f* indicate an upper end and a lower end of the second cylinder 5. This embodiment mode 3 has a different point from the above-described embodiment mode 1. That is, the line-shaped conductors 5*a* to 5*d* having the element lengths equal to an approximately ½ electromagnetic wavelength may constitute a line-shaped loop antenna in such a manner that the elements of the line-shaped conductors are shortcircuited to each other, and these elements are located opposite to each other at both the upper end 5*e* and the lower end 5*f* of the second cylinder 5. The 2-element length of this line-shaped loop antenna is equal to such a length defined by multiplying an approximately 1 electromagnetic wave by an integer number.

Next, a basic principle of operation will be described.

Similar to the embodiment mode 1, in such a case that the 4-element dipole array antennas 4*a* to 4*d* provided on the first cylinder 4 are energized by feeding electric power via the feeding line path 3 while the phase is led along the left circular direction, the second cylinder 5 having the 4-element line-shaped conductors 7*a* to 7*d* is located in the vicinity of the upper space of the first cylinder 4 while the second cylinder 5 is not electrically connected to the first cylinder 4, and further, an interval between the first cylinder 4 and the second cylinder 5 is selected to be a proper value, the 4-element dipole array antennas 4*a* to 4*d* provided on the surface of the first cylinder 4 are capacitive-coupled to the 4-element line-shaped conductors 7*a* to 7*d* provided on the surface of the second cylinder 5. As previously explained, the 4-elements line-shaped conductors 7*a* to 7*d* are short-circuited to the elements with each other, which are located opposite to the upper end 5*e* and the lower end 5*f* of the second cylinder 5. As a result, these 4-element line-shaped conductors 7*a* to 7*d* are energized by feeding electric power as the line-shaped loop antenna, and the two-element length of which becomes a length defined by multiplying an approximately 1 electromagnetic wavelength by an integer number.

It should be also noted that since the above-described 2-element line-shaped loop antenna is energized by feeding the electric power keeping a phase relationship similar to that of the respective elements of the dipole array antennas provided on the surface of the first cylinder 4, a similar antenna characteristic to that of the embodiment mode 1 can be obtained. Also, a point where the 2-element line-shaped loop antennas are intersected on the surface of the upper end 5*e* and the lower end 5*f* of the second cylinder 5 is located at an axial symmetrical position. Therefore, even when the antenna elements are shortcircuited to each other, a similar performance can be obtained.

EMBODIMENT MODE 4

Figure 9:
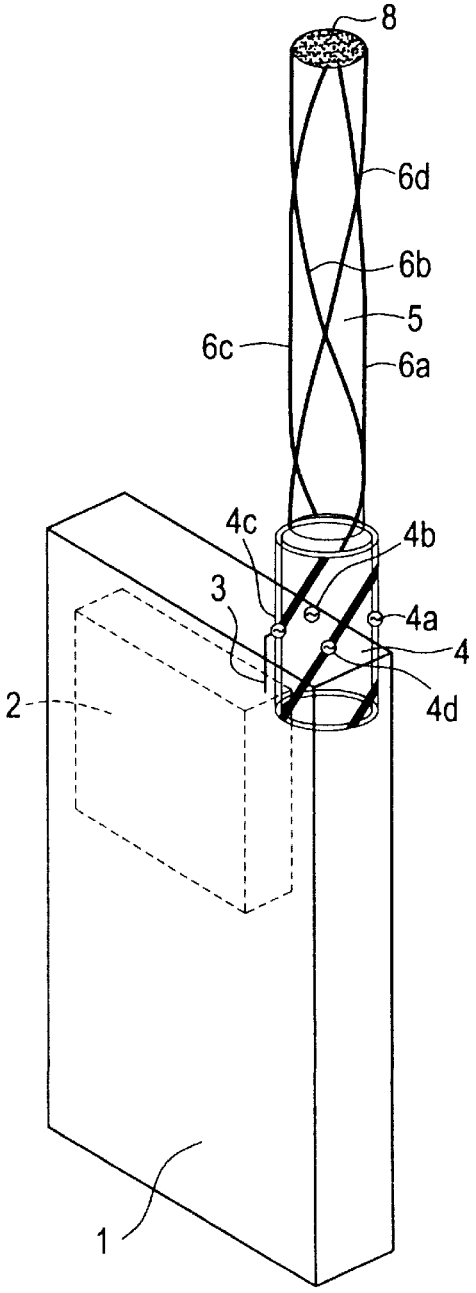
FIG. 9 is a conceptional structure diagram showing an antenna apparatus for a portable telephone according to an embodiment mode 4 of the present invention.

FIG. 9 is a conceptional structure diagram showing an embodiment mode 4 of the present invention.

It should be understood that the same reference numerals shown in the embodiment mode 2 of FIG. 7 will be employed as those for denoting the same, or similar structural elements indicated in FIG. 9, and descriptions thereof are omitted. As newly employed reference numeral, reference numeral 8 indicates a disk-shaped conductor provided on an upper end of the second cylinder 5. This disk-shaped conductor 8 shortcircuits 4-element line-shaped conductors 6*a* to 6*d* provided on the surface of the second cylinder 5. Since the line-shaped conductors 6*a* to 6*d* are shortcircuited by the disk-shaped conductor 8, a pair of line-shaped conductors intersected to each other are constituted. The line-shaped conductors 6*a* to 6*d* have element lengths equal to such a length defined by multiplying an approximately ¼ electromagnetic wavelength by an odd number. Also, an element length of the line-shaped conductor pair is equal to a length defined by multiplying an approximately ½ electromagnetic wavelength by an integer number.

Next, a basic principle of operation will be described.

Similar to the embodiment mode 2, in such a case that the 4-element dipole array antennas 4*a* to 4*d* provided on the first cylinder 4 are energized by feeding electric power via the feeding line path 3 while the phase is led along the left circular direction, the second cylinder 5 having the 4-element line-shaped conductors 6*a* to 6*d* is located in the vicinity of the upper space of the first cylinder 4 while the second cylinder 5 is not electrically connected to the first cylinder 4, and further, an interval between the first cylinder 4 and the second cylinder 5 is selected to be a proper value, the elements 4*a* to 4*d* provided on the surface of the first cylinder 4 are capacitive-coupled to the elements 6*a* to 6*d* provided on the surface of the second cylinder 5, and thus, this antenna apparatus is operated in a similar principal to that of the embodiment mode 2.

It should be noted that although the elements 6*a* to 6*d* provided on the surface of the second cylinder 5 are short-circuited by the disk-shaped conductor 8 on the upper end of the second cylinder 5, when the diameter of the second cylinder 5 is sufficiently smaller than the electromagnetic wavelength, since the potentials at the surface of the disk-shaped conductor 8 are substantially equal to each other, the antenna apparatus according to the embodiment mode 4 may be operated in a similar principal to that of the embodiment mode 2.

EMBODIMENT MODE 5

Figure 10:
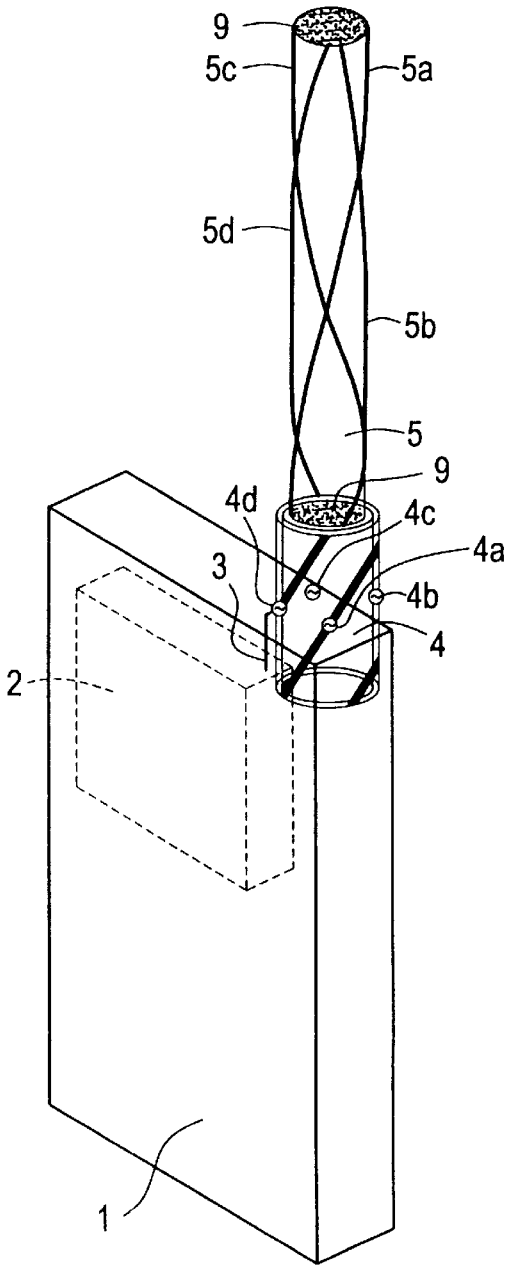
FIG. 10 is a conceptional structure diagram showing an antenna apparatus for a portable telephone according to an embodiment mode 5 of the present invention.

FIG. 10 is a conceptional structure diagram showing an embodiment mode 5 of the present invention.

It should be understood that the same reference numerals shown in the embodiment mode 1 of FIG. 1 will be employed as those for denoting the same, or similar structural elements indicated in FIG. 10, and descriptions thereof are omitted. As a newly employed reference numeral, reference numeral 9 indicates one pair of disk-shaped conductors. This pair of disk-shaped conductors 9 are provided on both an upper end and a lower end of the second cylinder 5, and also shortcircuit the 4-element line-shaped conductors 5*a* to 5*d* provided on the surface of the second cylinder 5. The line-shaped conductors 5*a* to 5*d* having element lengths equal to an approximately ½ electromagnetic wavelength may constitute a line-shaped loop antenna, since the elements thereof which are located opposite to each other at the upper end and the lower end of the second cylinder 5 are shortcircuited by one pair of disk-shaped conductors 9. In this case, an element length of two elements is equal to a length defined by multiplying an approximately 1 electromagnetic wavelength.

Next, a basic principal of operation will be described.

Similar to the embodiment mode 1, in such a case that the 4-element dipole array antennas 4*a* to 4*d* provided on the first cylinder 4 are energized by feeding electric power via the feeding line path 3 while the phase is led along the left circular direction, the second cylinder 5 having the 4-element line-shaped conductors 5*a* to 5*d* is located in the vicinity of the upper space of the first cylinder 4 while the second cylinder 5 is not electrically connected to the first cylinder 4, and further, an interval between the first cylinder 4 and the second cylinder 5 is selected to be a proper value, the elements 4*a* to 4*d* provided on the surface of the first cylinder 4 are capacitive-coupled to the elements 5*a* to 5*d* provided on the surface of the second cylinder 5. Thus, this antenna apparatus of the embodiment 5 is operated in a similar principal to that of the embodiment mode 3.

It should be noted that although the elements 5*a* to 5*d* provided on the surface of the second cylinder 5 are short-circuited by one pair of the disk-shaped conductors 9, when the diameter of the second cylinder 5 is sufficiently smaller than the electromagnetic wavelength, since the potentials at the surfaces of one pair of the disk-shaped conductors 9 are substantially equal to each other, the antenna apparatus according to the embodiment mode 5 may be operated in a similar principal to that of the embodiment mode 3.

EMBODIMENT MODE 6

Figure 11:
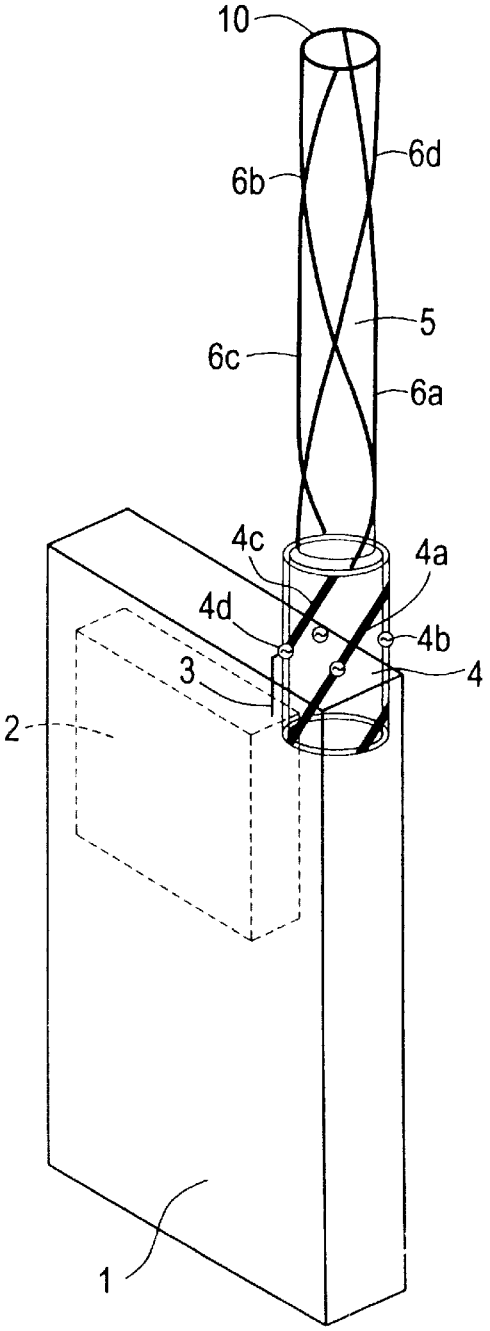
FIG. 11 is a conceptional structure diagram showing an antenna apparatus for a portable telephone according to an embodiment mode 6 of the present invention.

FIG. 11 is a conceptional structure diagram showing an embodiment mode 6 of the present invention.

It should be understood that the same reference numerals shown in the embodiment mode 4 of FIG. 9 will be employed as those for denoting the same, or similar structural elements indicated in FIG. 11, and descriptions thereof are omitted. As a newly employed reference numeral, reference numeral 10 indicates a toroidal-shaped conductor provided on the surface of a second cylinder 5. This toroidal-shaped conductor 10 shortcircuits 4-element line-shaped conductors 6*a* to 6*d* provided on the surface of the second cylinder 5. Since the elements located opposite to each other on the upper edge of the second cylinder 5 are shortcircuited by the toroidal-shaped conductor 10, a pair of line-shaped conductors intersected to each other are constituted. A 2-element length of the line-shaped conductor pair is equal to a length defined by multiplying an approximately ½ wavelength by an integer number.

Next, a basic principal of operation will be described.

Similar to the embodiment mode 1, in such a case that the 4-element dipole array antennas 4*a* to 4*d* provided on the first cylinder 4 are energized by feeding electric power via the feeding line path 3 while the phase is led along the left circular direction, the second cylinder 5 having the 4-element line-shaped conductors 6*a* to 6*d* is located in the vicinity of the upper space of the first cylinder 4 while the second cylinder 5 is not electrically connected to the first cylinder 4, and further, an interval between the first cylinder 4 and the second cylinder 5 is selected to be a proper value, the elements 4*a* to 4*d* provided on the surface of the first cylinder 4 are capacitive-coupled to the elements 6*a* to 6*d* provided on the surface of the second cylinder 5. Thus, the antenna apparatus of the embodiment mode 6 is operated in a similar principal to that of the embodiment mode 2.

It should be noted that although the elements 6*a* to 6*d* provided on the surface of the second cylinder 5 are short-circuited by the toroidal-shaped conductor 10 on the upper end of the second cylinder 5, when the diameter of the second cylinder 5 is sufficiently smaller than the electromagnetic wavelength, since the potentials at the surface of the toroidal-shaped conductor 10 are substantially equal to each other, the antenna apparatus according to the embodiment mode 6 may be operated in a similar principal to that of the embodiment mode 2.

EMBODIMENT MODE 7

Figure 12:
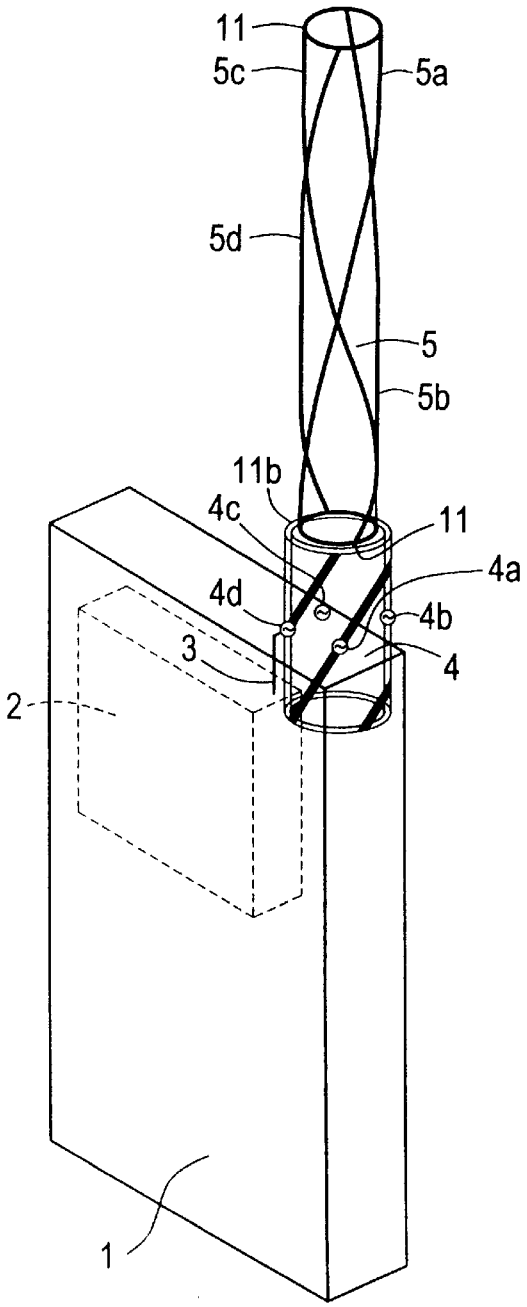
FIG. 12 is a conceptional structure diagram showing an antenna apparatus for a portable telephone according to an embodiment mode 7 of the present invention.

FIG. 12 is a conceptional structure diagram showing an embodiment mode 7 of the present invention.

It should be understood that the same reference numerals shown in the embodiment mode 5 of FIG. 10 will be employed as those for denoting the same, or similar structural elements indicated in FIG. 12, and descriptions thereof are omitted. As a newly employed reference numeral, reference numeral 11 indicate troidal-shaped conductors provided on an upper end and a lower end of the second cylinder 5. The toroidal-shaped conductors 11 shortcircuit the 4-element line-shaped conductors 5*a* to 5*d* provided on the surface of the second cylinder 5. The line-shaped conductors 5*a* to 5*d* having element lengths equal to an approximately ½ electromagnetic wavelength may constitute a line-shaped loop antenna, since the elements positioned opposite to each other on the upper end and the low end of the second cylinder 5 are shortcircuited by the toroidal-shaped conductor 11. In this case, a 2-element length of the line-shaped loop antenna is equal to a length defined by multiplying an approximately 1 electromagnetic wavelength by an integer number.

Next, a basic principal of operation will be described.

Similar to the embodiment mode 1, in such a case that the 4-element dipole array antennas 4*a* to 4*d* provided on the first cylinder 4 are energized by feeding electric power via the feeding line path 3 while the phase is led along the left circular direction, the second cylinder 5 having the 4-element line-shaped conductors 5*a* to 5*d* is located in the vicinity of the upper space of the first cylinder 4 while the second cylinder 5 is not electrically connected to the first cylinder 4, and further, an interval between the first cylinder 4 and the second cylinder 5 is selected to be a proper value, the elements 4*a* to 4*d* provided on the surface of the first cylinder 4 are capacitive-coupled to the elements 5*a* to 5*d* provided on the surface of the second cylinder 5. As a result, the antenna apparatus of the embodiment mode 7 is operated in a similar principal to that of the embodiment mode 3.

It should be noted that although the elements 5*a* to 5*d* provided on the surface of the second cylinder 5 are short-circuited by one pair of the toroidal-shaped conductors 11 on the surface of the upper end and the lower end of the second cylinder 5, when the diameter of the second cylinder 5 is sufficiently smaller than the electromagnetic wavelength, since the potentials at the surfaces of one pair of the toroidal-shaped conductors 11 are substantially equal to each other, the antenna apparatus according to the embodiment mode 7 may be operated in a similar principal to that of the embodiment mode 3.

FEASIBILITY OF INDUSTRIAL UTILIZATION

As previously described, in accordance with an antenna apparatus for a portable telephone of the present invention, since the movable radiation elements are provided in the vicinity of the fixed antenna for energization purpose in such a manner that these movable radiation elements are stacked on this fixed antenna in a coaxial manner but are not electrically connected to this fixed antenna, this antenna apparatus for the portable telephone can have the better circularly polarized wave characteristic and the superior portability.

What is claimed is:

1. An antenna apparatus for a portable telephone, comprising:

a first cylinder provided in such a manner that said first cylinder is uprighted on an upper portion of a housing of said portable telephone;

4-element dipole array antennas connected to a transmitter/receiver circuit built in said housing via a feeding line path, and arranged on the surface of said first cylinder in an equiinterval in such a manner that said 4-element dipole array antennas have inclined angles with respect to a central axis of said first cylinder, an element length of said 4-element dipole array antennas being equal to an approximately ½ electromagnetic wavelength;

a second cylinder having a diameter smaller than an inner diameter of said first cylinder, and arranged in such a manner that said second cylinder can be stored into said first cylinder, and when said second cylinder is drawn from said first cylinder, said second cylinder is uprighted in the vicinity of an upper space of said first cylinder in a coaxial manner; and 4-element line-shaped conductors arranged on the surface of said second cylinder in an equiinterval in such a manner that said 4-element line-shaped conductors have inclined angles with respect to a central axis of said second cylinder.

2. An antenna apparatus for a portable telephone as claimed in claim 1, characterized in that each of said 4-element line-shaped conductors has an element length equal to an approximately ½ electromagnetic wavelength.

3. An antenna apparatus for a portable telephone as claimed in claim 2, characterized in that 2 sets of elements among said 4-element line-shaped conductors located opposite to each other with respect to a central axis of said second cylinder are shortcircuited at an upper end and a lower end of said second cylinder.

4. An antenna apparatus for a portable telephone as claimed in claim 2, characterized by further comprising:

one pair of disk-shaped conductors provided on an upper end and a lower end of said second cylinder, all of said 4-element line-shaped conductors being shortcircuited by said one pair of disk-shaped conductors on the upper end and the lower end of said second cylinder.

5. An antenna apparatus for a portable telephone as claimed in claim 2, characterized by further comprising:

one pair of toroidal-shaped conductors provided on an upper end and a lower end of said second cylinder, all of said 4-element line-shaped conductors being shortcircuited by said one pair of toroidal-shaped conductors on the upper end and the lower end of said second cylinder.

6. An antenna apparatus for a portable telephone as claimed in claim 1, characterized in that each of said 4-element line-shaped conductors has an element length equal to a length defined by multiplying an approximately ¼ electromagnetic wavelength by an odd number; and 2 sets of line-shaped conductors among the 4-element line-shaped conductors located opposite to each other with respect to a central axis of said second cylinder are shortcircuited with each other at upper end of said second cylinder.

7. An antenna apparatus for a portable telephone as claimed in claim 1, characterized in that each of said 4-element line-shaped conductors has an element length equal to a length defined by multiplying an approximately ¼ electromagnetic wavelength by an odd number; and by further comprising a disk-shaped conductor provided on an upper end of said second cylinder, all of said 4-element line-shaped conductors being shortcircuited by said disk-shaped conductor on the upper end of said second cylinder.

8. An antenna apparatus for a portable telephone as claimed in claim 1, characterized in that each of said 4-element line-shaped conductors has an element length equal to a length defined by multiplying an approximately ¼ electromagnetic wavelength by an odd number; and by further comprising a toroidal-shaped conductor provided on an upper end of said second cylinder, all of said 4-element line-shaped conductors being shortcircuited by said toroidal-shaped conductor on the upper end of said second cylinder.

* * * * *